United States Patent [19]

Miller

[11] 4,063,436

[45] Dec. 20, 1977

[54] STRONGHOLD COMBINATION LOCK

[75] Inventor: Norman Miller, Lafayette, Ind.

[73] Assignee: Schwab Safe Co., Inc., Lafayette, Ind.

[21] Appl. No.: 734,972

[22] Filed: Oct. 22, 1976

[51] Int. Cl.[2] ..... E05B 65/06; E05B 63/20; E05B 37/04

[52] U.S. Cl. ..... 70/133; 70/309; 292/175; 292/335

[58] Field of Search ..... 292/145, 152, 153, 175, 292/335; 70/115, 119, 122, 126, 129, 130, 131, 132, 133, 138, 302, 309

[56] References Cited

U.S. PATENT DOCUMENTS

| | | | |
|---|---|---|---|
| 244,783 | 7/1881 | Arnold | 70/133 |
| 316,285 | 4/1885 | McKeen | 292/335 |
| 601,975 | 4/1898 | Morris | 70/133 X |
| 1,107,736 | 8/1914 | Wilkinson et al. | 292/335 |
| 1,662,449 | 3/1928 | Zubow | 292/335 |
| 2,597,056 | 5/1952 | Beder | 292/335 |
| 2,797,271 | 6/1957 | Augustine | 70/302 X |
| 2,881,612 | 4/1959 | Smith et al. | 70/302 |
| 3,063,282 | 11/1962 | Aytes | 70/133 X |

FOREIGN PATENT DOCUMENTS

| | | | |
|---|---|---|---|
| 157,285 | 12/1952 | Australia | 70/302 |
| 820,764 | 4/1937 | France | 292/335 |
| 537,267 | 2/1922 | France | 292/335 |
| 372,613 | 3/1923 | Germany | 70/119 |

*Primary Examiner*—Roy D. Frazier
*Assistant Examiner*—Thomas J. Holko
*Attorney, Agent, or Firm*—Cushman, Darby & Cushman

[57] ABSTRACT

A combination lock with a combination dial having a shaft extending through an elliptically shaped door aperture, through a wheel post, and through an elliptically shaped aperture in a lock stand to mount a cam and a plurality of locking wheels each having a slot which when properly positioned permits sliding movement of the dial, post wheels and a locking bolt mounted on the post to a release position in response to manually applied lateral force as the aligned slots move into an upstanding fence on the stand. A spring connected to the stand extends about the post to urge the post in the opposite direction toward a latch position. A detent member is pivotably mounted on the door with an upstanding portion engaging a cut-out portion of the bolt to latch the bolt in the release position and a cam portion which engages a rail on the door jamb when the door is shut to pivot the detent member against the urging of a spring to disengage the upstanding portion and permit the bolt, dial, wheels and post to return to the latch position.

6 Claims, 3 Drawing Figures

STRONGHOLD COMBINATION LOCK

BRIEF DESCRIPTION OF THE PRIOR ART AND SUMMARY OF THE INVENTION

The invention relates to a simple combination lock with a locking bolt which can be shifted to a latch position to permit entry through a protected door.

Conventional locks of this type have been used in which a bolt is mounted in conjunction with a conventional combination dial. When the dial is rotated to the correct position, the circular motion thereof is translated into a linear motion which retracts the bolt. The difficulty with such locks is that the mechanical arrangement for retracting the bolt is overly complex, leading to an expensive mechanical configuration.

The U.S. Pat. No. 244,783, to Arnold, issued on July 26, 1881 describes a lock of this general sort in which three wheels are rotated to a position with a radial notch in alignment with a tongue so that gears and a coupled dial can be moved to withdraw the bolt. The U.S. Pat. Nos. 116,737 to Miller and Aytes 3,063,282 show other arrangements of this sort.

The present invention relates to a simple and unique lock in which the combination dial extends through an elliptically shaped aperture in a door or other entry device to engage a locking bolt and a plurality of conventional locking wheels, the entire assembly being slideable in the elliptically shaped opening. A spring engages a wheel post within the door through which the shaft extends and which mounts the bolt to urge the post and the locking bolt toward a latch position. A detent member is pivotably attached to the door by a suitable pin and includes an upstanding portion engaging a cut-out area on the lock bolt for maintaining the locking bolt in a release position. A rail on the door jamb engages a cam surface of the detent member to cause rotation thereof against the urging of another spring disposed about the pin to release the bolt and cause the bolt and dial to be moved into the latch position.

Other objects and purposes of the invention will be clear from the following detailed description of the drawings.

DETAILED DESCRIPTION OF THE DRAWINGS

Figure 1:
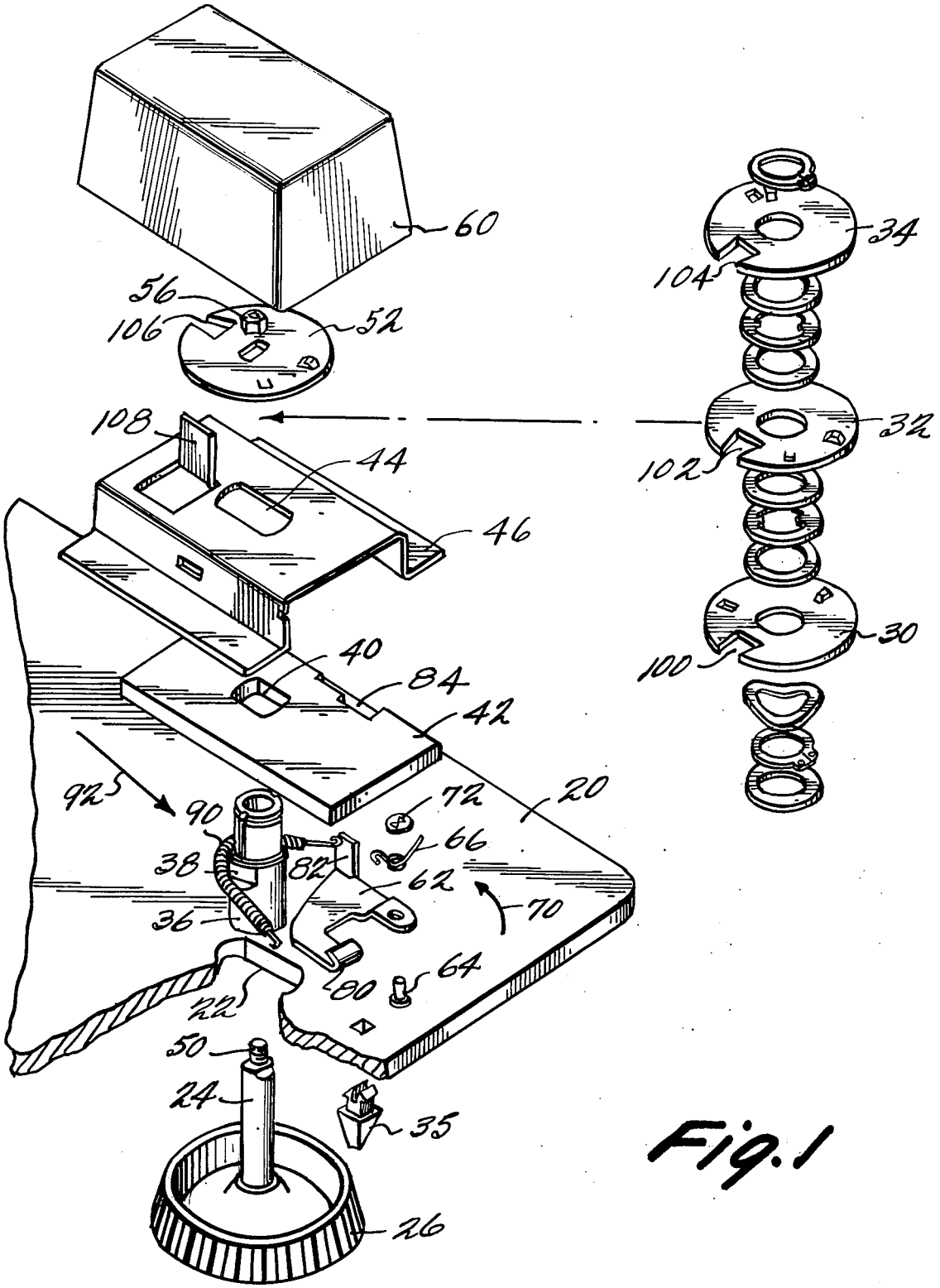
FIG. 1 shows an exploded view of the lock of the present invention with part of the door removed for clarity.
Figure 2:
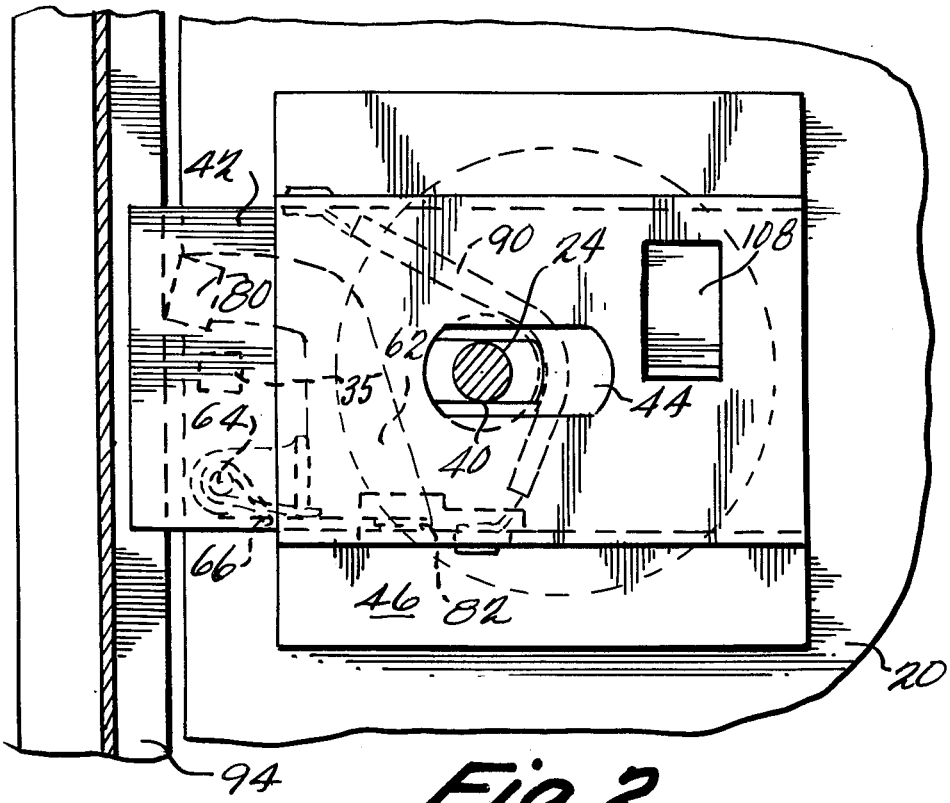
FIG. 2 shows a top plan view of the lock of the present invention in the latch position with the cover, locking wheels and associated parts removed.
Figure 3:
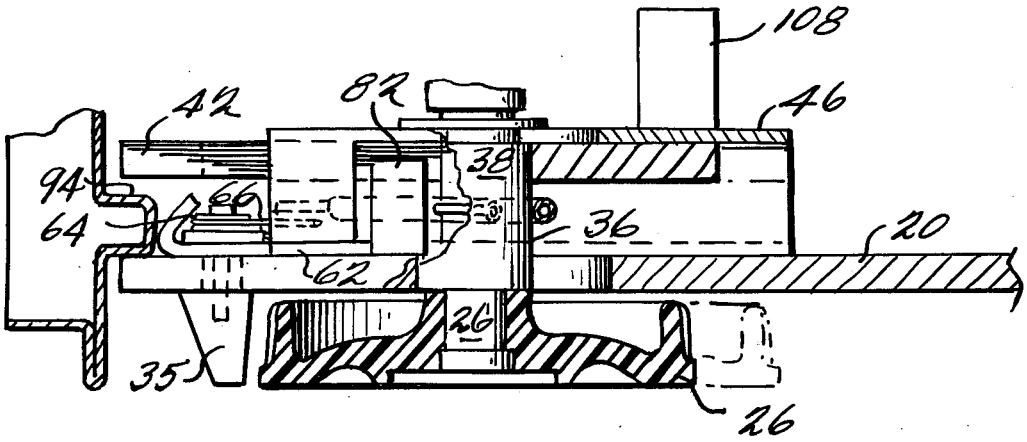
FIG. 3 shows a fragmentary vertical sectional view of FIG. 2.

Reference is now made to FIGS. 1-3 which illustrate one embodiment of the present invention. The lock is installed on a conventional door 20, for example a file drawer, which is provided with an elliptically shaped opening 22 which is roughly equal in its minor axis length to the diameter of wheel post 36 which extends therethrough and has a length of its major axis greater than the diameter of post 36 and equal to the travel of the locking bolt as will become apparent from the discussion below.

Shaft 24 is rigidly attached to a conventional combination dial 26 which bears thereon numbers or other indicia for indicating from the exterior of door 20 the position of dial 26 and accordingly by sequential manipulation of dial 26, the positions of a plurality of conventional locking wheels 30, 32 and 34. Combination lock index 35 indicates the dial position.

Wheel post 36 is mounted on shaft 24 for permitting rotation therein as can be best seen in FIG. 1 and more particularly has a central bore through which shaft 24 extends. Wheel post 36 is provided with flat portions 38 on opposite sides thereof which engage similar surfaces 40 of a locking bolt 42 which is formed of conventional material and of strength sufficient enough so as to prevent ready entry by bending or breaking bolt 42. Post 36 further extends through an elliptically shaped aperture 44 in a lock stand 46, the dimensions of aperture 44 corresponding to the dimensions of aperture 22 in door 20. Lock stand 46 is preferably rigidly attached to door 20 by screws or in some other way.

The threaded end 50 of shaft 24 which extends upward beyond the end of the post 36 receives cam 52 and locking wheels 32, 34 and 30. Cam 52 rotates with shaft 24 and cooperates with locking wheels 30, 32 and 34 to provide a conventional combination dial lock. Cam 52 and locking wheels 30, 32, and 34 are secured to the threaded end 50 of shaft 24 by a conventional nut 56. The entire lock assembly is covered by a lock cover 60 which attaches in any suitable fashion to the lock stand 46.

The other components of the lock include a detent member 62 which is pivotably connected to door 20 by a pin 64 which defines a pivot point. Spring 66 extends about pin 64 atop detent member 62. One end of spring 66 engages detent member 62 while the other end engages the upwardly extending side of lock stand 46 as can be best seen by the dashed lines in FIG. 2 to urge detent member 62 to rotate in the direction of the arrow 70 indicated in FIG. 1. A conventional push-on nut 72 holds spring 66 onto pin 64. Detent member 62 includes a cam portion 80 and an upstanding portion 82 which latter portion engages a cut-out portion 84 of bolt 42. Spring 90 is attached to opposite sides of stand 46 and urges post 36 and, through post 36, shaft 24, dial 26, bolt 42, cam 52 and wheels 30, 32 and 34 in the direction of arrow 92 toward the latch position. In this position, the bolt 42 extends beyond rail 94 to prevent door 20 from being opened.

When the dial is manipulated sequentially, in a conventional fashion, to properly align slots 100, 102, 104, and 106 of wheels 30, 32 and 34 and cam 52, respectively, the aligned slots can be slid by manual application of a lateral force in a direction opposite to arrow 92 against the urging of spring 90 so that fence 108, which is a cut-out and bent up portion of stand 46, extends into the aligned slots. Combination dial 26, shaft 24, and post 36 also, of course, move with bolt 42 in a direction opposite to that of arrow 92, as lateral pressure is manually applied to the dial. When the dial and associated structure have been moved in a direction opposite that of arrow 92 to the release position, the upstanding detent portion 82 pivots into contact with the cut-out portion 84 to hold the lock in the release position with the bolt withdrawn. To cause bolt 42 to move in the direction of arrow 92 to its locked position, door 20 need only be shut causing cam portion 80 to engage rail 94 and pivot member 62 about pin 64 in a direction opposite to that of arrow 70 and against the urging of spring 66 so that upstanding portion 82 is pivoted out of cut-out portion 84 permitting bolt 42 to move in the direction of arrow 92 under the urging of spring 90 to the latch position.

Many changes and modifications in the above described embodiment of the invention can, of course, be carried out without departing from the scope of the invention. The material and components can be any conventional material used in locks, for example, metal, formed in any conventional way. The lock can be used with any kind of door, for example, with file drawers, and the like. Accordingly, that scope is intended to be limited only by the scope of the appended claims.

What is claimed is:

1. A combination lock for locking a door comprising:

a combination dial having a shaft for rotation therewith and adapted for extending through an aperture in said door and for sliding movement in said aperture along said door;

a locking bolt;

means coupling said bolt to said dial for sliding movement therewith between a latch and a release position, including a wheel post having a bore through which said shaft extends, said bolt being mounted about said post;

a lock stand adapted to be fixed to said door and having a fence;

a plurality of locking wheels engaging said shaft for rotation therewith, each of said wheels having a slot and being positioned so that when said slots are aligned adjacent said fence, said bolt, dial, and locking wheels can be moved by manually applied lateral pressure to said dial from said release to said latch position as said aligned slots move into said fence;

a first spring extending about said post and attached at opposite ends to said stand for urging said dial, bolt and wheels toward said locking position; and detent means adapted to be pivotably fixed to said door and releasably engaging said bolt in said release position to retain said bolt in said release position, including a pivot pin, a detent member having an upstanding detent portion for engaging a cut-out portion of said bolt, an aperture through which said pin extends to define a pivot point and a cam surface for engaging a rail on the door jamb when the door is closed to pivot said detent member so that said detent portion moves out of engagement with said cut-out portion and said bolt can move to said latch position under the influence of said first spring, and a second spring disposed about said pin for engaging said detent member to urge rotation of said detent member about said pin in a direction causing said detent portion to engage said cut-out portion.

2. A lock as in claim 1, wherein said bolt has an aperture through which said post and one end of said shaft extend, wherein said stand has an aperture through which said one shaft end and post extend, wherein said one end of said shaft is threaded and including a nut for engaging said threaded end to maintain said wheels between said nut and said stand.

3. A lock as in claim 1 further including a cover member covering said stand bolt, post, detent member, locking wheels and first spring.

4. A lock as in claim 1, further including said door.

5. A lock as in claim 1, further including a door jamb mounting said rail.

6. A lock as in claim 1, wherein said stand has an elliptically shaped aperture through which said shaft extends and wherein said aperture in said door has an elliptical shape.

* * * * *